US008076619B1

(12) United States Patent
Wingale

(10) Patent No.: US 8,076,619 B1
(45) Date of Patent: Dec. 13, 2011

(54) HEATED FLOOR MAT FOR ELEVATED SURFACES AND ASSOCIATED METHOD

(76) Inventor: Mason Wingale, Randallstown, MD (US)

( * ) Notice: Subject to any disclaimer, the term of this patent is extended or adjusted under 35 U.S.C. 154(b) by 1023 days.

(21) Appl. No.: 11/975,147

(22) Filed: Oct. 18, 2007

(51) Int. Cl.
*H05B 3/54* (2006.01)
*E04G 7/00* (2006.01)

(52) U.S. Cl. ..... 219/528; 182/178.1

(58) Field of Classification Search ..... 219/523–525, 219/527–542, 544–549; 182/178.1–178.6; 14/69.5, 71.1
See application file for complete search history.

(56) References Cited

U.S. PATENT DOCUMENTS 2,745,942 A * 5/1956 Cohen ..... 219/528
5,062,174 A * 11/1991 DaSalvo ..... 14/69.5
5,550,350 A 8/1996 Barnes
5,854,470 A 12/1998 Silva
6,180,929 B1 1/2001 Pearce

* cited by examiner

*Primary Examiner* — Sang Paik

(57) ABSTRACT

A heated stair mat includes a plurality of coextensively shaped mats configured in a staggered arrangement along a plurality of vertical and horizontal walls of the existing steps such that odd ones of the mats cover top surfaces of the existing steps while even ones of the mats cover front surfaces of the existing steps. Each of such mats is provided with a plurality of laterally spanning grooves juxtaposed between the heating elements and formed on top surfaces of the mats respectively. Such grooves have axially opposed open end portions for directing fluids and debris away from the top surface of the mats. The device further includes a plurality of heating elements, a mechanism for rotatably connecting the odd and even mats to each other, and a plurality of ring-shaped couplings.

12 Claims, 3 Drawing Sheets

HEATED FLOOR MAT FOR ELEVATED SURFACES AND ASSOCIATED METHOD

CROSS REFERENCE TO RELATED APPLICATIONS

This application claims the benefit of U.S. Provisional Application No. 60/849,746, filed Oct. 6, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to mats and, more particularly, to a heated stair mat for heating existing stairway steps.

PRIOR ART

During the winter months, many people can be found outside their home or apartment, laboriously wielding a snow shovel to remove snow from their driveways and walkways. Sometimes the city sends a truck to shovel the streets and drop salt on icy areas but this does not, however, solve the problem of getting from one's front door to the shoveled streets. The task of removing accumulated snow from driveways, walkways, sidewalks and outdoor stairways must be accomplished by hard, manual labor, using a snow shovel to scoop up, lift, and heave the snow to the sides.

In addition to shoveling snow, retail businesses face the added task of shoveling sand or snow on storefront sidewalks to afford traction for pedestrians and customers to safeguard against individuals slipping and possibly being injured. These types of shoveling tasks are physically demanding, so much so that people over the age of fifty are cautioned not to perform this laborious job as it could be dangerous, especially for those that are not physically fit. Obviously is would be advantageous to provide a means for preventing snow and ice from accumulating in pedestrian areas.

U.S. Pat. No. 5,550,350 to Barnes discloses a device and method for melting ice and snow from walkways and steps. The device includes a rigid block of heat-conducting plastic suitable for mounting on steps. An electrical heating element provides heat. The heat is distributed to the entire block and melts the snow or ice on the surface. Unfortunately, this prior art example is not resistant to dirt and oil.

U.S. Pat. No. 5,854,470 to Silva discloses a system for melting snow and ice near a walking path thereby preventing slipping of individuals. The inventive device includes a mat having a plurality of drain slots, a tube projecting within the mat, a pump connected to both ends of the tube for circulating heated oil, and a heating coil surrounding a portion of the tube for heating the oil within the tube during circulation. Unfortunately, this prior art example does not include a non-skid surface.

U.S. Pat. No. 6,180,929 to Pearce discloses a lightweight flexible electrical heating device for melting snow and ice that may be cut in the field to custom length. The device includes a planar flexible electric heater sandwiched between two vulcanized polymer protective sheets. The heater include an array of resistive heating elements electrically connected in parallel and oriented substantially across the device length, allowing the heater to be cut to any length as needed. Potentially the outside surfaces are equipped with a ribbed non skid pattern that forms an array of ribs and channels to increase traction and aid in water drainage. Unfortunately, this prior art example is not designed specifically for stair and walkway use.

Accordingly, the present invention is disclosed in order to overcome the above noted shortcomings. The present invention satisfies such a need by providing a device that is convenient and easy to use, durable in design, and designed for heating existing stairway steps. The heated stair mat is simple to use, inexpensive, and designed for many years of repeated use.

BRIEF SUMMARY OF THE INVENTION

In view of the foregoing background, it is therefore an object of the present invention to provide a device for heating existing stairway steps. These and other objects, features, and advantages of the invention are provided by a heated stair mat.

A heated stair mat includes a plurality of coextensively shaped mats effectively configured in a staggered arrangement along a plurality of vertical and horizontal walls of the existing steps such that odd ones of the mats cover top surfaces of the existing steps while even ones of the mats cover front surfaces of the existing steps. Each of such mats is provided with a plurality of laterally spanning grooves juxtaposed between the heating elements and formed on top surfaces of the mats respectively. Such grooves have axially opposed open end portions for directing fluids and debris away from the top surface of the mats.

The device further includes a plurality of heating elements embedded within the mats respectively, and a controller electrically coupled to a first one of the odd mats such that power is distributed directly to the first odd mat. Remaining ones of the mats are conveniently spaced from the controller, and a portable power source is electrically coupled to the controller and adjustably positioned exterior of the mats.

The device further includes a mechanism for rotatably connecting the odd and even mats to each other in such a manner that each of the odd and even mats are advantageously pivoted along an arcuate path and about respective fulcrum axis extending parallel to longitudinal edges of the odd and even mats. The arcuate path extends along at least 180 degrees so that the mats are vertically stacked during non-use conditions. The rotatably connecting mechanism effectively includes a plurality of conductive brackets attached to the longitudinal edges of each of the mats such that adjacent ones of the heating elements are continuously and electrically mated to each other while the mats are rotated between horizontal and vertical orientations respectively.

Each of such conductive brackets is electrically coupled to an associated one of the heating elements respectively, and each of the brackets conveniently has an axial bore formed therein and extending outwardly from the longitudinal edges of the mats respective. The brackets are disposed adjacent to opposed ends of the mats, and a plurality of rectilinear shafts has axially opposed ends removably anchored to the brackets and spaced away from the longitudinal edges respectively. Selected ones of the brackets have tongues formed at distal ends thereof, other ones of the brackets have grooves formed at distal ends thereof, and the tongues and grooves are directly mated while the mats are rotated along the arcuate path for preventing the mats from undesirably oscillating away from the arcuate path.

The device further includes a plurality of ring-shaped couplings advantageously looped about the shafts and slidably positional along respective longitudinal lengths thereof. Adjacent ones of the shafts maintain fixed spatial relationships while the couplings freely travel along the shafts. The couplings include O-rings with a smooth arcuate inner surface abutted against the shafts respectively. The couplings remain medially adjoined between the adjacent ones of the longitudinal edges of the mats respectively.

A method for heating existing stairway steps includes the steps of: configuring a plurality of shaped mats a staggered arrangement along a plurality of vertical and horizontal walls of the existing steps such that odd ones of the mats cover top surfaces of the existing steps while even ones of the mats cover front surfaces of the existing steps; providing a plurality of heating elements embedded within the mats respectively; electrically coupling a controller to a first one of the odd mats such that power is distributed directly to the first odd mat while remaining ones of the mats remain spaced from the controller; electrically coupling a portable power source to the controller; rotatably connecting the odd and even mats to each other in such a manner that each of the odd and even mats are pivoted along an arcuate path and about respective fulcrum axis extending parallel to longitudinal edges of the odd and even mats; and adapting the mats along the arcuate path extending along at least 180 degrees so that the mats become vertically stacked during non-use conditions.

The method further includes the steps of: attaching a plurality of conductive brackets to the longitudinal edges of each of the mats such that adjacent ones of the heating elements are continuously and electrically mated to each other while the mats are rotated between horizontal and vertical orientations respectively; removably anchoring one end of a plurality of rectilinear shafts to the brackets while maintaining the shafts spaced away from the longitudinal edges respectively; and lopping a plurality of ring-shaped about the shafts by slidably positioning the couplings along respective longitudinal lengths of the shafts; and removably anchoring another end of a plurality of rectilinear shafts to the brackets.

The method further includes the step of: directly mating corresponding tongues and grooves of the bracket while the mats are rotated along the arcuate path for preventing the mats from undesirably oscillating away from the arcuate path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
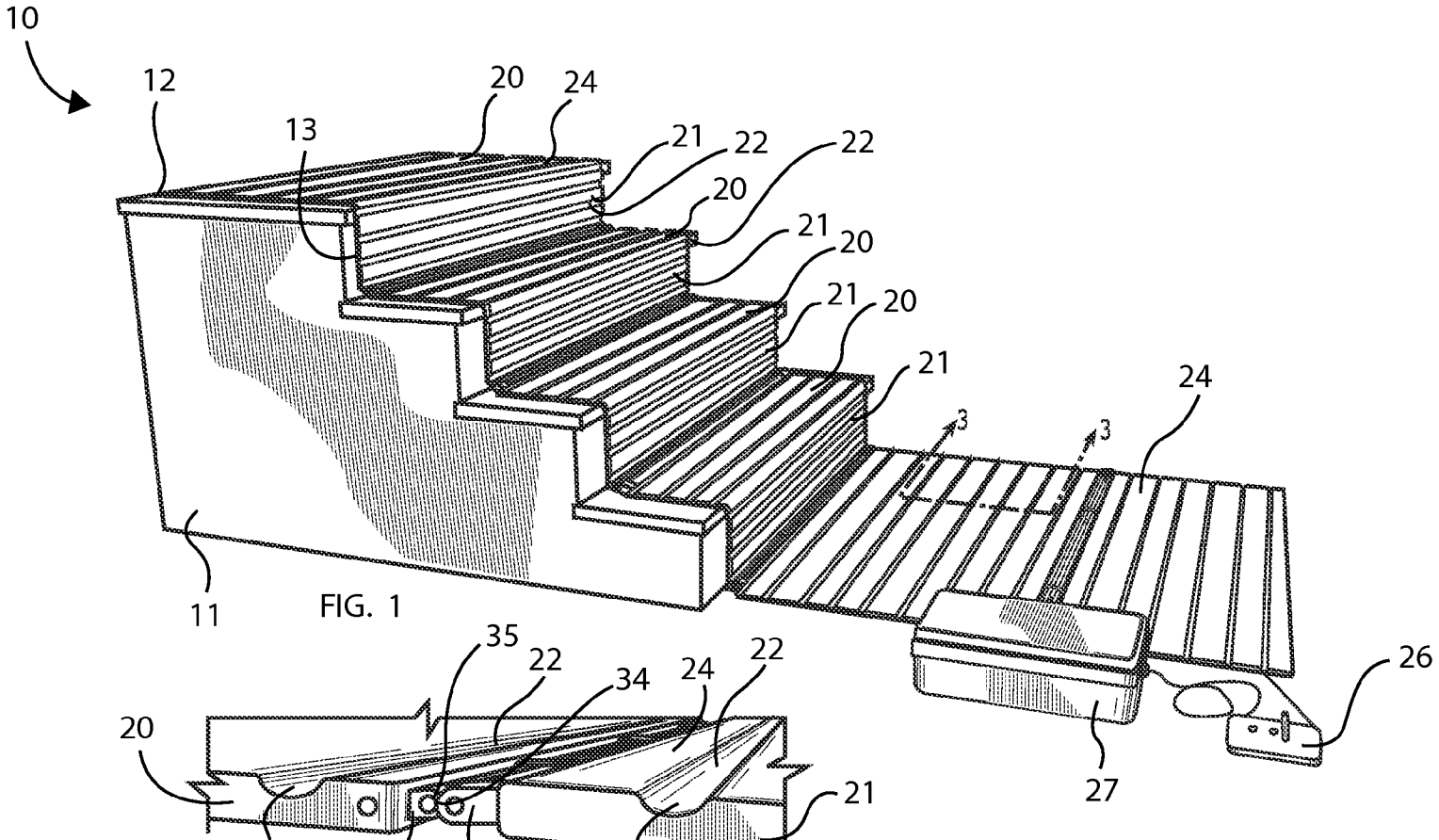
FIG. 1 is a perspective view showing heat mat positioned on an existing stairway, in accordance with the present invention.
Figure 2:
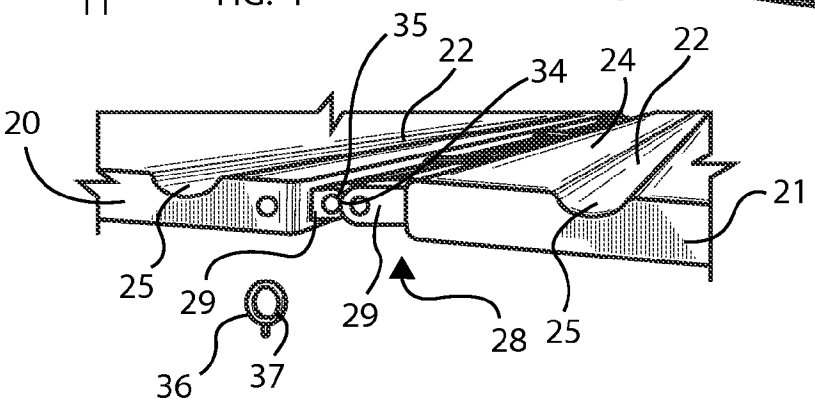
FIG. 2 is an enlarged partial view of the rotatably connecting means.
Figure 3:
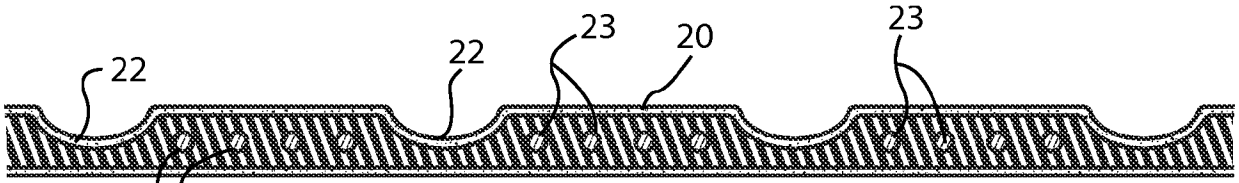
FIG. 3 is a cross-sectional view of a mat showing the heating element embedded therein.
Figure 4:
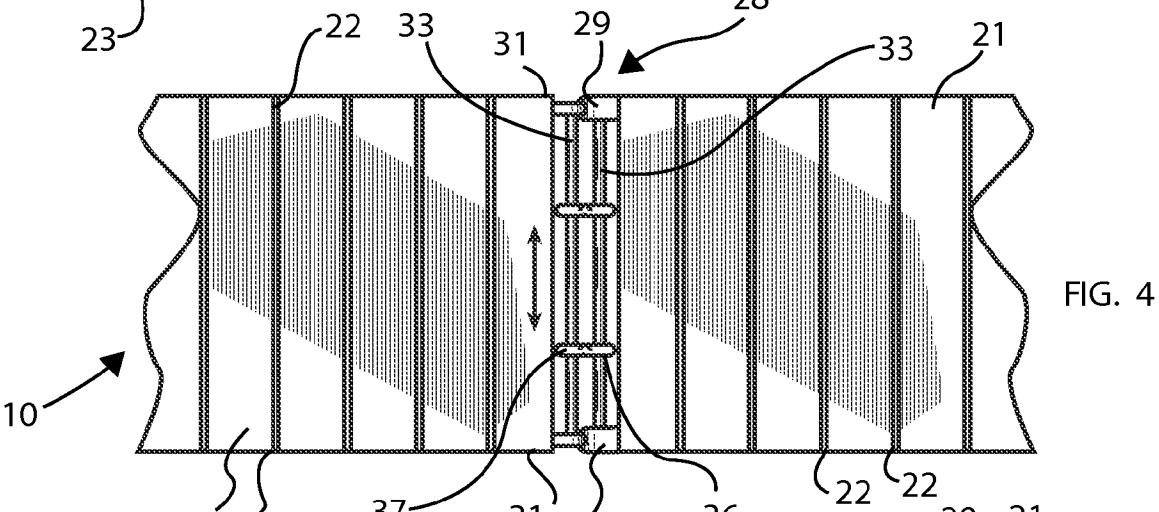
FIG. 4 is a top plan view showing a pair adjoining mats rotatably connected together.
Figure 5:
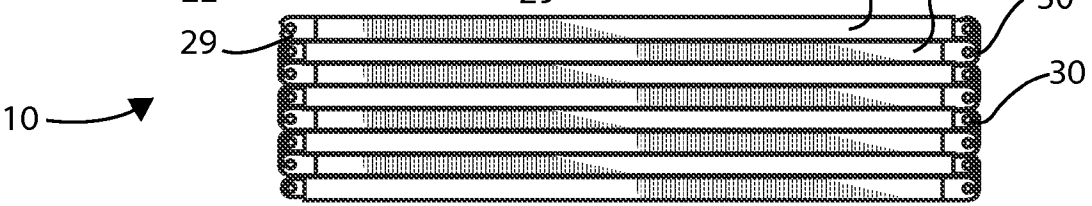
FIG. 5 is a side elevational view showing a plurality of the heated mats stacked in a vertical manner.
Figure 6:
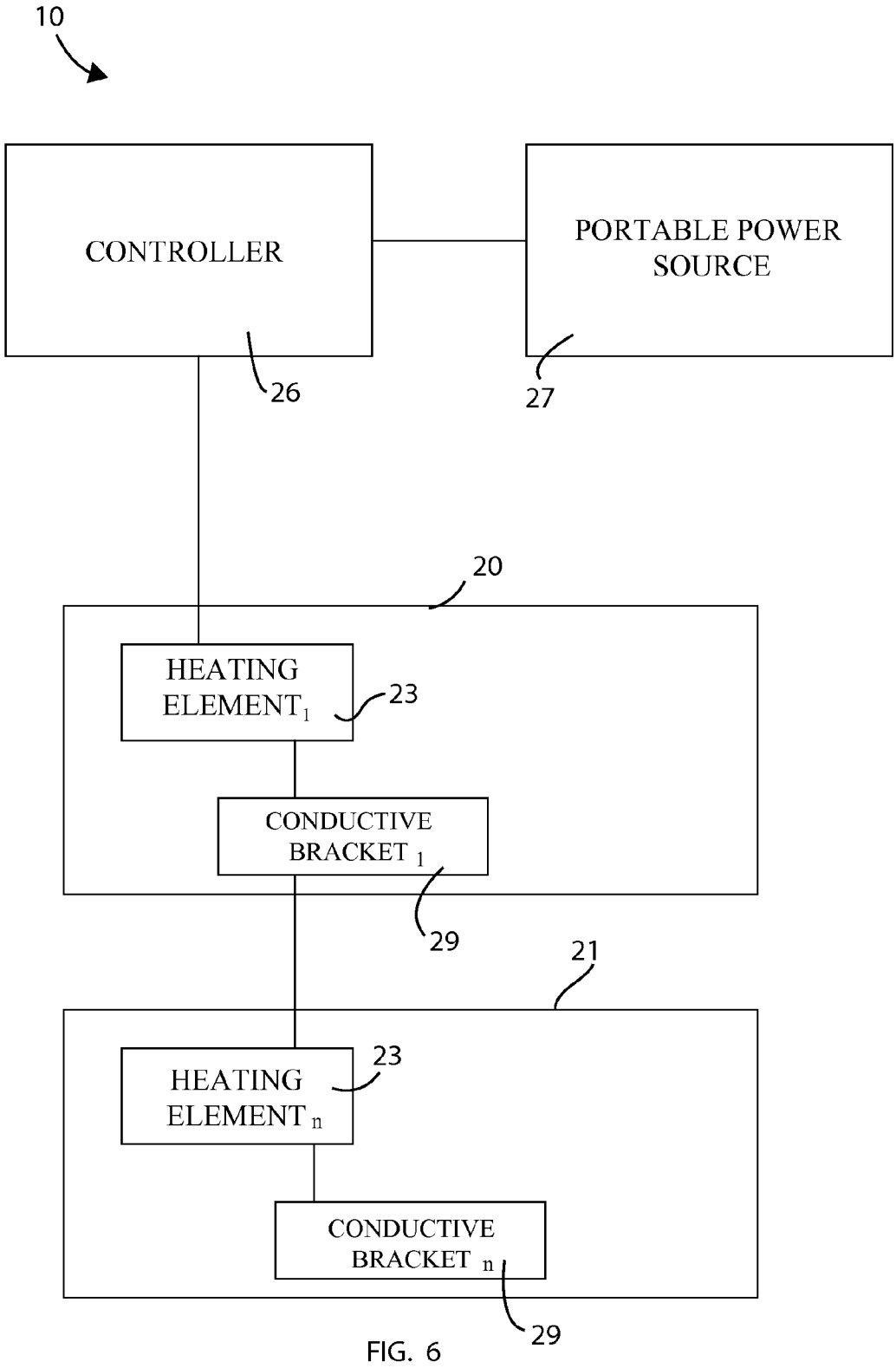
FIG. 6 is a schematic block diagram of showing the interrelationship of the electronic elements of the present invention.

The apparatus of this invention is referred to generally in FIGS. 1-6 by the reference numeral 10 and is intended to protect a heated stair mat. It should be understood that the apparatus 10 may be used to protect many different types of surfaces and should not be limited in covering only those types of surfaces mentioned herein.

Referring initially to FIGS. 1-5, a heated stair mat 10 includes a plurality of coextensively shaped mats 20, 21 configured in a staggered arrangement along a plurality of vertical and horizontal walls 12, 13 of the existing steps 11 which is essential such that odd ones of the mats 20 cover top surfaces 12 of the existing steps while even ones of the mats 21 cover front surfaces 13 of the existing steps 11. Each of such mats 20, 21 is provided with a plurality of laterally spanning grooves 22 juxtaposed between the heating elements 23 and formed on top surfaces 24 of the mats 20, 21 respectively. Such grooves 22 have axially opposed open end portions 25 for directing fluids and debris away from the top surface 24 of the mats 20, 21. The even and odd mats 20, 21 provide a covering for both the top and front surfaces 12, 13 of the steps 11, thereby ensuring that the entire area is safely maintained without snow and ice.

Referring to FIGS. 1-5, the device 10 further includes a plurality of heating elements 23 embedded within the mats 20, 21 respectively, and a controller 26 electrically coupled to a first one of the odd mats 20 which is important such that power is distributed directly, without the use of intervening elements, to the first odd mat 20. Remaining ones of the mats 21 are spaced from the controller 26, and a portable power source 27 is electrically coupled to the controller 26 and adjustably positioned exterior of the mats 20, 21. The heating elements 23 effectively ensure that the all of the snow and ice on the surface area is completely melted.

Referring to FIGS. 1-5, the device 10 further includes a mechanism 28 for rotatably connecting the odd and even mats 20, 21 to each other in such a manner that each of the odd and even mats 20, 21 are pivoted along an arcuate path and about respective fulcrum axis extending parallel to longitudinal edges of the odd and even mats 20, 21. The arcuate path extends along at least 180 degrees so that the mats 20, 21 are vertically stacked during non-use conditions. The rotatably connecting mechanism 28 includes a plurality of conductive brackets 29 attached to the longitudinal edges of each of the mats 20, 21 which is vital such that adjacent ones of the heating elements 23 are continuously and electrically mated to each other while the mats 20, 21 are rotated between horizontal and vertical orientations respectively. The rotatably connecting mechanism 28 allows the device 10 to be folded for easy storage procedures.

Each of such conductive brackets 29 is electrically coupled to an associated one of the heating elements 23 respectively, and each of the brackets 29 has an axial bore 30 formed therein and extending outwardly from the longitudinal edges of the mats 20, 21 respective. The brackets 29 are disposed adjacent to opposed ends 31 of the mats 20, 21, and a plurality of rectilinear shafts 32 has axially opposed ends 33 removably anchored to the brackets 29 and spaced away from the longitudinal edges respectively. Selected ones of the brackets 29 have tongues 34 formed at distal ends thereof, other ones of the brackets 29 have grooves 35 formed at distal ends thereof, and the tongues 34 and grooves 35 are directly mated, without the use of intervening elements, while the mats 20, 21 are rotated along the arcuate path for preventing the mats 20, 21 from undesirably oscillating away from the arcuate path.

Referring to FIGS. 1-5, the device 10 further includes a plurality of ring-shaped couplings 36 looped about the shafts 32 and slidably positional along respective longitudinal lengths thereof. Adjacent ones of the shafts 32 maintain fixed spatial relationships while the couplings 36 freely travel along the shafts 32. The couplings 36 include O-rings 37 with a smooth arcuate inner surface abutted against the shafts 32 respectively. The couplings 36 remain medially adjoined between the adjacent ones of the longitudinal edges of the mats 20, 21 respectively.

In use, the heated stair mat is simple and easy to operate. When the device is in use, the highly resistive wire material converts electrical energy (current) into thermal energy (heat) which is dissipated throughout the cover, keeping the outer surface area warm, advantageously preventing the accumulation of ice and snow. After use, the device is simply removed from the designated surface, rolled into a tight coil and conveniently stored away in the carrying case until again needed.

The device includes a heated, tarp-like cover that measures ½-1" in total depth and is produced from slip-resistant rubber material. Such a cover includes an internally contained, insulated heating element. Such an element is sandwiched between two layers of the cover, which is important for heating the entire surface thereof. The wire runs in a lopped configuration which traverses the length and width of the cover, thus advantageously heating the entire cover. The outer surface of the cover is also oil and grease resistant, and is resistant to drying, rolling and cracking. Once activated, the temperature of the insulated heating element quickly rises, thus effectively warming the surface of the cover and efficiently melting any accumulated ice or snow.

The outer surface of the cover is textured, and includes a plurality of thick, nonskid ridges that are designed to advantageously ensure steady and stable footing for pedestrians. A plurality of annular drainage channels are evenly spaced across the surface of the cover, thus advantageously and effectively enabling the melted snow or ice to easily run-off the surface of the cover, to the ground below. The device is powered by way of a 12 hour rechargeable battery. Each cover measures three feet by four feet, and are easily connected to accommodate long or short driveways and particularly wide storefront sidewalks. These covers are effectively secured together by way of a plurality of insulated adapter cords that are appropriately positioned on either end of the device. A storage case is provided for conveniently facilitating compact storage of the device when it is not in use.

The present invention, as claimed, provides the unexpected and unpredictable benefit of a device that is convenient and easy to use, is durable yet lightweight in design, is versatile in its applications, and offers users an effective means of eliminating ice and snow from driveways, walkways and stairways. By incorporating a heating element into a practical covering, the device eliminates the need to spend precious minutes and hours laboriously scooping away snow. In this manner, the snow melting system eradicates one of the most difficult and arduous tasks faced by people who live in snow-prone areas. Boasting a nonskid surface which ensures steady footing while easily allowing melted ice and snow to run off the surface of the mat, the device enables users to traverse their driveway, walkway or steps, quickly and safely. Further, as this surface is resistant to grease and oil, as well as drying, rolling and cracking, the device can effectively withstand repeated wear and tear, with ease. Simple in application, the heated stair mat is particularly ideal on early mornings when one may be running late for work. With the device covering their entranceway, working men and women are able get out on the road in a quick and expedient manner. Moreover, senior citizens and individuals who suffer from limited physical capabilities do not have to risk injury trying to shovel away snow. In addition, retail establishments can employ the present invention to prevent the accumulation of snow, ice, and salt, making the sidewalks in front of their stores safer for their customers and passersby.

In use, a method for heating existing stairway steps includes the steps of: configuring a plurality of shaped mats a staggered arrangement along a plurality of vertical and horizontal walls of the existing steps such that odd ones of the mats cover top surfaces of the existing steps while even ones of the mats cover front surfaces of the existing steps; providing a plurality of heating elements embedded within the mats respectively; electrically coupling a controller to a first one of the odd mats such that power is distributed directly to the first odd mat while remaining ones of the mats remain spaced from the controller; electrically coupling a portable power source to the controller; rotatably connecting the odd and even mats to each other in such a manner that each of the odd and even mats are pivoted along an arcuate path and about respective fulcrum axis extending parallel to longitudinal edges of the odd and even mats; and adapting the mats along the arcuate path extending along at least 180 degrees so that the mats become vertically stacked during non-use conditions.

In use, the method further includes the steps of: attaching a plurality of conductive brackets to the longitudinal edges of each of the mats such that adjacent ones of the heating elements are continuously and electrically mated to each other while the mats are rotated between horizontal and vertical orientations respectively; removably anchoring one end of a plurality of rectilinear shafts to the brackets while maintaining the shafts spaced away from the longitudinal edges respectively; and lopping a plurality of ring-shaped about the shafts by slidably positioning the couplings along respective longitudinal lengths of the shafts; and removably anchoring another end of a plurality of rectilinear shafts to the brackets.

In use, the method further includes the step of: directly mating corresponding tongues and grooves of the bracket while the mats are rotated along the arcuate path for preventing the mats from undesirably oscillating away from the arcuate path.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and that is desired to secure by Letters Patent of the United States is:

1. A heated stair mat for heating existing stairway steps, said heated stair mat comprising:

a plurality of mats configured in a staggered arrangement along a plurality of vertical and horizontal walls of the existing steps such that odd ones of said mats cover top surfaces of the existing steps while even ones of said mats cover front surfaces of the existing steps;

a plurality of heating elements embedded within said mats respectively;

a controller electrically coupled to a first one of said odd mats such that power is distributed directly to said first odd mat, remaining ones of said mats being spaced from said controller;

a portable power source electrically coupled to said controller and adjustably positioned exterior of said mats; and means for rotatably connecting said odd and even mats to each other in such a manner that each of said odd and even mats are pivoted along an arcuate path and about respective fulcrum axis extending parallel to longitudinal edges of said odd and even mats, said arcuate path extending along at least 180 degrees so that said mats are vertically stacked during non-use conditions;

wherein said rotatably connecting means comprises:

a plurality of conductive brackets attached to said longitudinal edges of each of said mats such that adjacent ones of said heating elements are continuously and electrically mated to each other while said mats are rotated between horizontal and vertical orientations respectively, each of said conductive brackets being electrically coupled to an associated one of said heating elements respectively, each of said brackets having an axial bore formed therein and extending outwardly from said longitudinal edges of said mats respective, said brackets being disposed adjacent to opposed ends of said mats, a plurality of rectilinear shafts having axially opposed ends removably anchored to said brackets and spaced away from said longitudinal edges respectively; and a plurality of ring-shaped couplings looped about said shafts and slidably positional along respective longitudinal lengths thereof;

wherein adjacent ones of said shafts maintain fixed spatial relationships while said couplings freely travel along said shafts.

2. The heated stair mat of claim 1, wherein selected ones of said brackets have tongues formed at distal ends thereof, other ones of said brackets have grooves formed at distal ends thereof, said tongues and grooves being directly mated while said mats are rotated along said arcuate path for preventing said mats from undesirably oscillating away from said arcuate path.

3. The heated stair mat of claim 1, wherein said couplings remain medially adjoined between said adjacent ones of said longitudinal edges of said mats respectively.

4. The heated stair mat of claim 1, each of said mats is provided with a plurality of laterally spanning grooves juxtaposed between said heating elements and formed on top surfaces of said mats respectively, said grooves having axially opposed open end portions for directing fluids and debris away from said top surface of said mats.

5. The heated stair mat of claim 1, wherein said couplings comprises: O-rings having a smooth arcuate inner surface abutted against said shafts respectively.

6. A heated stair mat for heating existing stairway steps, said heated stair mat comprising:

a plurality of coextensively shaped mats configured in a staggered arrangement along a plurality of vertical and horizontal walls of the existing steps such that odd ones of said mats cover top surfaces of the existing steps while even ones of said mats cover front surfaces of the existing steps;

a plurality of heating elements embedded within said mats respectively;

a controller electrically coupled to a first one of said odd mats such that power is distributed directly to said first odd mat, remaining ones of said mats being spaced from said controller;

a portable power source electrically coupled to said controller and adjustably positioned exterior of said mats; and means for rotatably connecting said odd and even mats to each other in such a manner that each of said odd and even mats are pivoted along an arcuate path and about respective fulcrum axis extending parallel to longitudinal edges of said odd and even mats, said arcuate path extending along at least 180 degrees so that said mats are vertically stacked during non-use conditions;

wherein said rotatably connecting means comprises:

a plurality of conductive brackets attached to said longitudinal edges of each of said mats such that adjacent ones of said heating elements are continuously and electrically mated to each other while said mats are rotated between horizontal and vertical orientations respectively, each of said conductive brackets being electrically coupled to an associated one of said heating elements respectively, each of said brackets having an axial bore formed therein and extending outwardly from said longitudinal edges of said mats respective, said brackets being disposed adjacent to opposed ends of said mats, a plurality of rectilinear shafts having axially opposed ends removably anchored to said brackets and spaced away from said longitudinal edges respectively; and a plurality of ring-shaped couplings looped about said shafts and slidably positional along respective longitudinal lengths thereof;

wherein adjacent ones of said shafts maintain fixed spatial relationships while said couplings freely travel along said shafts.

7. The heated stair mat of claim 6, wherein selected ones of said brackets have tongues formed at distal ends thereof, other ones of said brackets have grooves formed at distal ends thereof, said tongues and grooves being directly mated while said mats are rotated along said arcuate path for preventing said mats from undesirably oscillating away from said arcuate path.

8. The heated stair mat of claim 6, wherein said couplings remain medially adjoined between said adjacent ones of said longitudinal edges of said mats respectively.

9. The heated stair mat of claim 6, each of said mats is provided with a plurality of laterally spanning grooves juxtaposed between said heating elements and formed on top surfaces of said mats respectively, said grooves having axially opposed open end portions for directing fluids and debris away from said top surface of said mats.

10. The heated stair mat of claim 6, wherein said couplings comprises: O-rings having a smooth arcuate inner surface abutted against said shafts respectively.

11. A method for heating existing stairway steps, said method comprising the steps of:

a. configuring a plurality of shaped mats a staggered arrangement along a plurality of vertical and horizontal walls of the existing steps such that odd ones of said mats cover top surfaces of the existing steps while even ones of said mats cover front surfaces of the existing steps;

b. providing a plurality of heating elements embedded within said mats respectively;

c. electrically coupling a controller to a first one of said odd mats such that power is distributed directly to said first odd mat while remaining ones of said mats remain spaced from said controller;

d. electrically coupling a portable power source to said controller;

e. rotatably connecting said odd and even mats to each other in such a manner that each of said odd and even mats are pivoted along an arcuate path and about respective fulcrum axis extending parallel to longitudinal edges of said odd and even mats; and f. adapting said mats along said arcuate path extending along at least 180 degrees so that said mats become vertically stacked during non-use conditions;

wherein step e. comprises the steps of:

attaching a plurality of conductive brackets to said longitudinal edges of each of said mats such that adjacent ones of said heating elements are continuously and electrically mated to each other while said mats are rotated between horizontal and vertical orientations respectively;

removably anchoring one end of a plurality of rectilinear shafts to said brackets while maintaining said shafts spaced away from said longitudinal edges respectively; and lopping a plurality of ring-shaped about said shafts by slidably positioning said couplings along respective longitudinal lengths of said shafts; and removably anchoring another end of a plurality of rectilinear shafts to said brackets.

12. The method of claim 11, wherein step e. further comprises the step of:

directly mating corresponding tongues and grooves of said bracket while said mats are rotated along said arcuate path for preventing said mats from undesirably oscillating away from said arcuate path.

* * * * *

UNITED STATES PATENT AND TRADEMARK OFFICE

CERTIFICATE OF CORRECTION

PATENT NO. : 8,076,619 B1
APPLICATION NO. : 11/975147
DATED : December 13, 2011
INVENTOR(S) : Mason Wingate It is certified that error appears in the above-identified patent and that said Letters Patent is hereby corrected as shown below:

Title page, item [76] inventor, should read as follows:

Mason Wingate

Signed and Sealed this
Twenty-fourth Day of January, 2012

David J. Kappos

David J. Kappos
*Director of the United States Patent and Trademark Office*